US007044065B2

(12) United States Patent
Arai et al.

(10) Patent No.: US 7,044,065 B2
(45) Date of Patent: May 16, 2006

(54) ARTICLE TRANSPORTING/STORING DEVICE

(75) Inventors: Tomoaki Arai, Tokyo (JP); Satoshi Ishihara, Saitama (JP); Sakae Ishikawa, Kanagawa (JP); Juusei Matsumoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 360 days.

(21) Appl. No.: 10/611,976

(22) Filed: Jul. 3, 2003

(65) Prior Publication Data

US 2005/0188901 A1 Sep. 1, 2005

(30) Foreign Application Priority Data

Jul. 5, 2002 (JP) ..... 2002-198018

(51) Int. Cl.
*B65D 19/38* (2006.01)

(52) U.S. Cl. ..... 108/53.1; 108/55.1

(58) Field of Classification Search ..... 108/51.11, 108/53.1, 53.3, 53.5, 55.1, 55.3, 55.5, 57.17, 108/57.2, 57.29; 248/150; 135/67, 74, 66; 5/430; 206/600

See application file for complete search history.

(56) References Cited

U.S. PATENT DOCUMENTS

| | | | | |
|---|---|---|---|---|
| 1,188,839 | A * | 6/1916 | Schell | 16/327 |
| 2,862,720 | A * | 12/1958 | Stone et al. | 280/33.998 |
| 3,648,909 | A | 3/1972 | Wisecarver | |
| 4,018,154 | A | 4/1977 | Matsumoto et al. | |
| 4,942,434 | A | 7/1990 | Nakai et al. | |
| 5,398,832 | A * | 3/1995 | Clive-Smith | 220/1.5 |
| 5,415,311 | A * | 5/1995 | Coogan | 220/6 |
| 5,694,638 | A | 12/1997 | Maruyama et al. | |
| 6,279,763 | B1 | 8/2001 | Bush | |
| 6,293,400 | B1 | 9/2001 | Arai et al. | |
| 6,343,555 | B1 | 2/2002 | Arai et al. | |
| 6,422,407 | B1 | 7/2002 | Arai | |
| 6,463,863 | B1 | 10/2002 | Ishikawa et al. | |
| 6,602,032 | B1 | 8/2003 | Arai | |
| 6,866,160 | B1 * | 3/2005 | Wang et al. | 220/7 |

FOREIGN PATENT DOCUMENTS

| | | |
|---|---|---|
| DE | 1 556 719 | 3/1972 |
| DE | 25 06 746 | 8/1976 |
| FR | 2 638 431 | 5/1990 |
| FR | 2757831 | * 12/1996 |
| JP | 3012140 | 4/1995 |
| JP | 2595500 | 3/1999 |
| JP | 2001-151234 | 6/2001 |
| JP | 2001-315777 | 11/2001 |
| JP | 2002-29539 | 1/2002 |

* cited by examiner

*Primary Examiner*—Lanna Mai
*Assistant Examiner*—Timothy M. Ayres
(74) *Attorney, Agent, or Firm*—Oblon, Spivak, McClelland, Maier & Neustadt, P.C.

(57) ABSTRACT

An article transporting/storing device of the present invention includes a table to be loaded with a desired article. A pair of post units are spaced from each other, and each include two posts connected together. A pair of unit supporting devices respectively support the two post units on the table such that the post units are selectively locked in a position in which they stand substantially vertically on the table or unlocked and allowed to be angularly moved toward the mount surface of the table between the post units.

28 Claims, 10 Drawing Sheets

ARTICLE TRANSPORTING/STORING DEVICE

BACKGROUND OF THE INVENTION

1. Field of the Invention

The present invention relates to an article transporting/storing device of the type including a table to be loaded with a desired article and a plurality of posts mounted on the table.

2. Description of the Background Art

An article transporting/storing device of the type described and configured to transport or store various kinds of articles, including electric appliances and other industrial products, various parts, building materials and other materials, furniture and natural matters, is disclosed in Japanese Patent Laid-Open Publication No. 2001-315777 by way of example. To transport or store a desired article, after the article has been loaded on a table, a plurality of posts are mounted to the table around the article. Subsequently, the article is transported or stored together with the carrying/conveying device. On the other hand, after the article has been transported from one place to another place and then unloaded from the table, the posts are dismounted from the table and then folded up in a compact configuration, so that the transporting/storing device can be returned to the original place. This is also true when the transporting/storing device is stored when not used.

The problem with the conventional article transporting/storing device described above is that the plurality of posts must be repeatedly mounted and dismounted from the table, resulting in troublesome, inefficient work.

Technologies relating to the present invention are also disclosed in, e.g., Japanese Patent Laid-Open Publication No. 2001-151234 and Japanese Utility Model Publication Nos. 2,595,500 and 3,012,140.

SUMMARY OF THE INVENTION

It is an object of the present invention to provide an article transporting/storing device capable of solving the problem stated above.

An article transporting/storing device of the present invention includes a table to be loaded with a desired article. A pair of post units are spaced from each other, and each include two posts connected together. A pair of unit supporting devices respectively support the two post units on the table such that the post units are selectively locked in a position in which they stand substantially vertically on the table or unlocked and allowed to be angularly moved toward the mount surface of the table between the post units.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
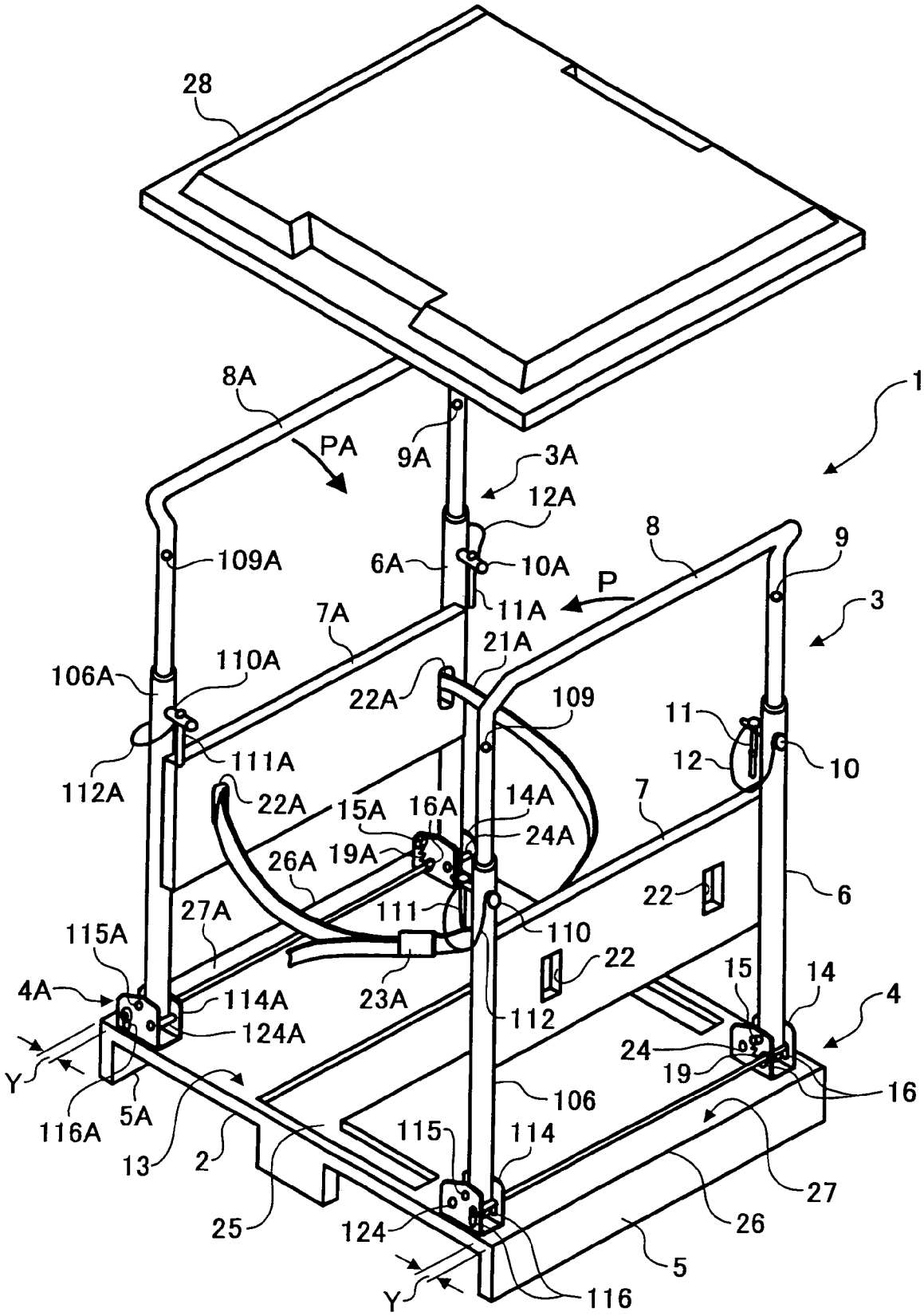
FIG. 1 is an isometric view showing an article transporting/storing device embodying the present invention.

Referring to FIG. 1 of the drawings, an article transporting/storing device embodying the present invention is shown and generally designated by the reference numeral 1. As shown, the article transporting/storing device 1 is generally made up of a table 2 to be loaded with a desired article or articles, a pair of post units 3 and 3A mounted on the table 2 face to face, and unit supporting means 4 and 4A for respectively supporting the post units 3 and 3A on the table 2. Legs 5 and 5A protrude downward from the table 2 to be put on, e.g., a floor, and extend horizontally in parallel to each other.

The two post units 3 and 3A and the two unit supporting means 4 and 4A each are identical in configuration except that they are arranged symmetrically to each other. The following description will therefore concentrate on the support unit 3 and unit supporting means 4 by way of example. The structural elements of the other support unit 3A and unit supporting means 4A are simply distinguished from the structural elements of the support unit 3 and unit supporting means 4 by suffice A.

Figure 3:
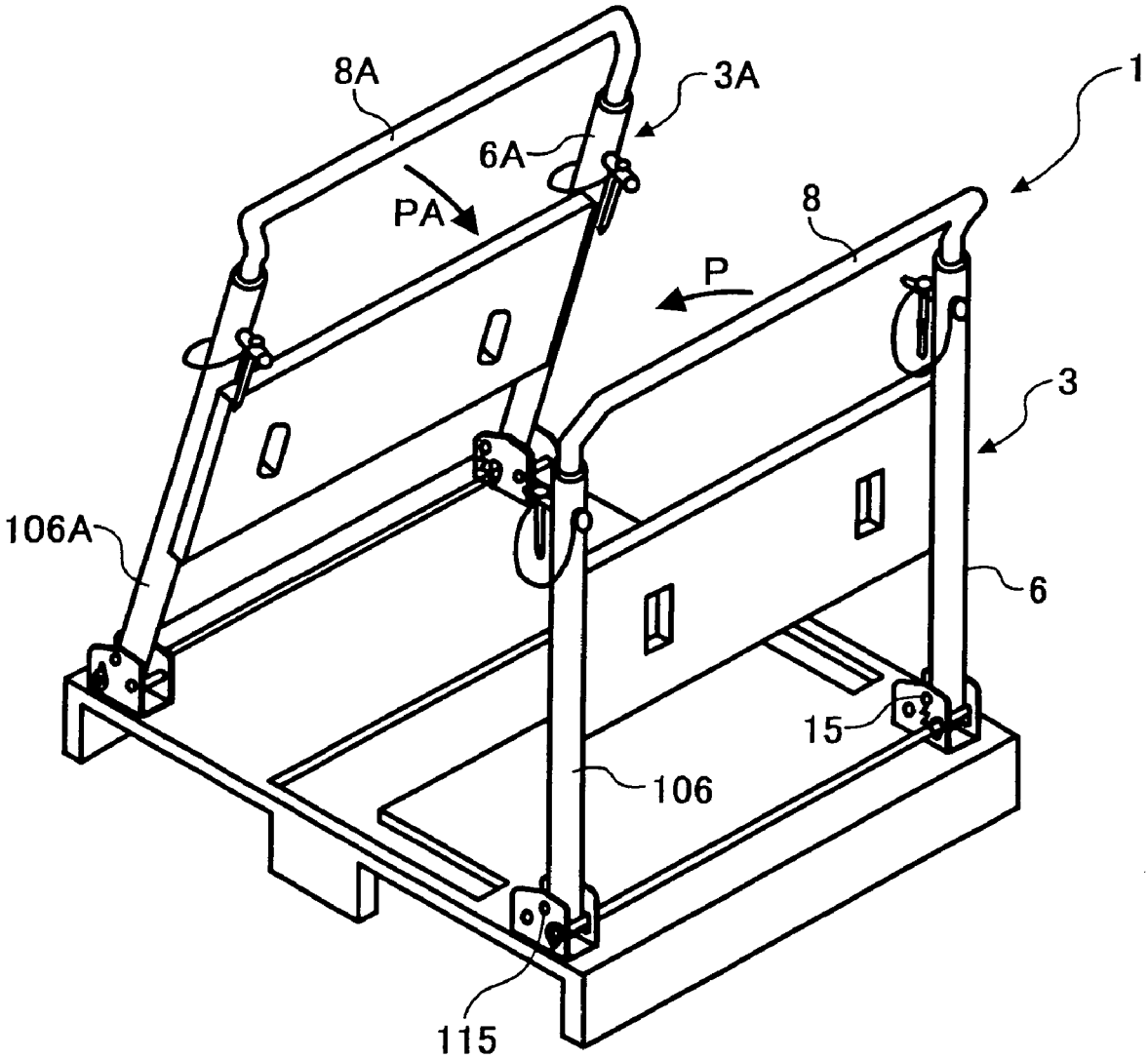
FIG. 3 is an isometric view showing a specific condition wherein one post unit has begun to be angularly moved.

The post unit 3 includes two posts 6 and 106 spaced from each other, but connected to each other, and implemented by hollow pipes. More specifically, in the illustrative embodiment, the posts 6 and 106 are connected together by a back plate 7 and a movable frame 8. The back plate 7 is fastened, welded or otherwise affixed to the posts 6 and 10. Opposite ends of the movable frame 8 are configured generally in the form of inverted letter "U" and respectively inserted in the posts or pipes 6 and 106 via the top openings. In this condition, the movable frame 8 may be slid downward to reduce the height of the post unit 3, as shown in FIG. 3, or slid upward to increase the height of the post unit 3, as shown in FIG. 1, as desired.

The moveable frame 8 is formed with through holes 9 and 109 and through holes, not shown, positioned below the through holes 9 and 109. After the through holes 9 and 109 or the other through holes of the movable frame 8 have been aligned with through holes formed in the posts 6 and 106, pins 10 and 110 are inserted into the through holes thus aligned to thereby fix the movable frame 8 to the posts 6 and 106. Stop pins 11 and 111 are removably inserted in the pins 10 and 110, respectively. The height of the post unit 3 can be adjusted by pulling out the stop pins 11 and 111 from the pins 10 and 110, respectively, then pulling out the pins 10 and 110 from the through holes, and then sliding the movable frame 8 upward or downward. Strings 12 and 112 are respectively affixed at opposite ends thereof to opposite ends of the pins 10 and 110 and stop pins 11 and 111, preventing the pins 10 and 110 and stop pins 11 and 111 from being lost.

The unit supporting means 4 selectively locks the posts 6 and 106 of the post unit 3 in a position standing substantially vertically on the table 2, as shown in FIG. 1, or unlocks and allows the post unit 3 to be angularly moved toward the mount surface 13 of the table 2 between the post units 3 and 103 in a direction indicated by an arrow P. More specifically, the unit supporting means 4 includes a pair of brackets 14 and 114 affixed to the table 2. The posts 6 and 106 are respectively supported by the brackets 14 and 114 via pins 15 and 115 in such a manner as to be angularly movable about the pins 15 and 115. The pins 15 and 115 extend throughout the brackets 14 and 114 and the lower end portions of the posts 6 and 106, respectively.

Figure 2:
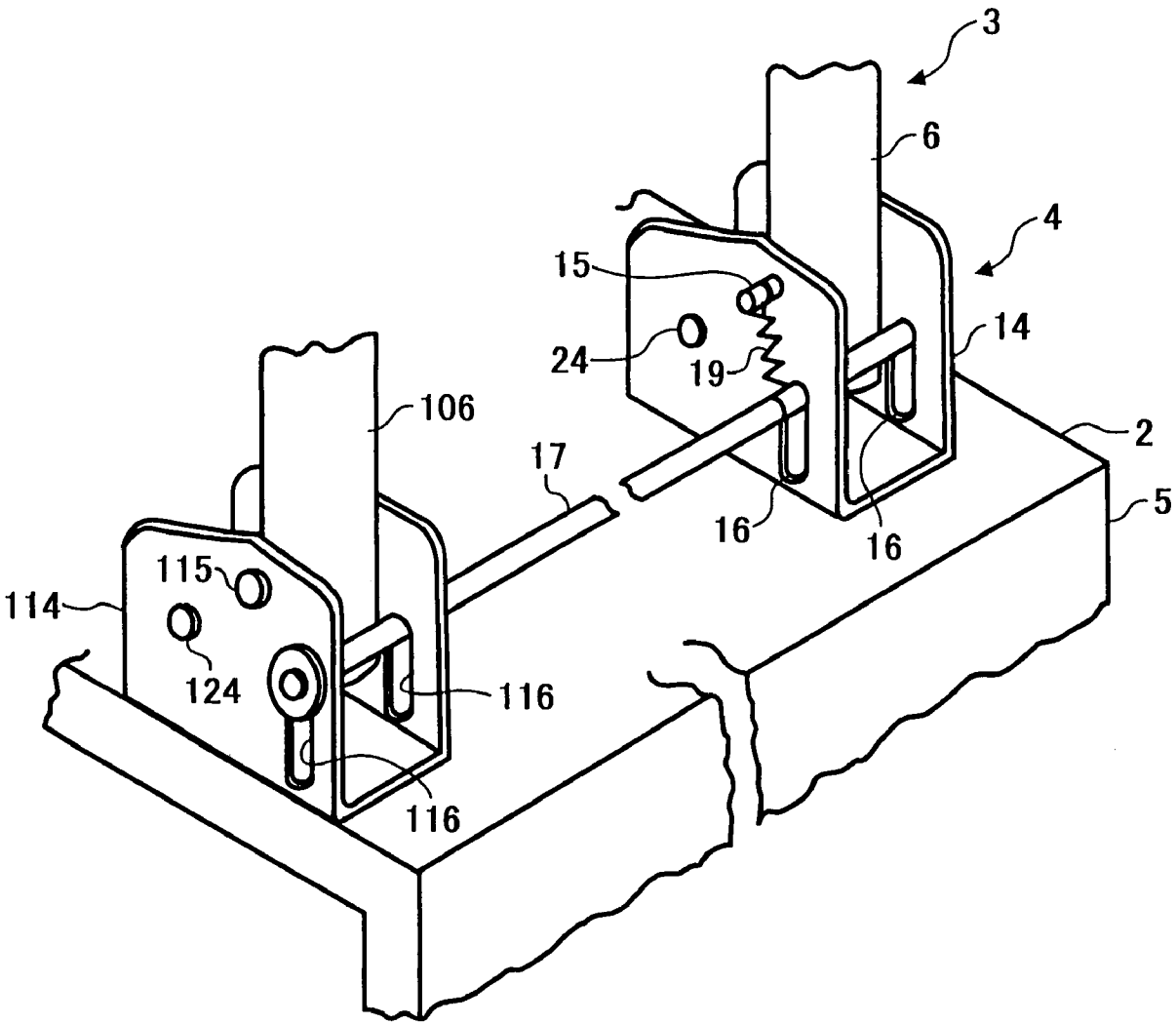
FIG. 2 is an enlarged, fragmentary isometric view showing one of a pair of post units included in the illustrative embodiment.

As shown in FIG. 2 in detail, the unit supporting means 4 includes a movable rod 17 extending throughout slots 16 and 116 formed in the brackets 14 and 114, respectively. The slots 16 and 11.6 are elongate in the up-and-down direction, so that the movable rod 17 is movable upward or downward along the slots 16 and 116. The brackets 14 and 114 may be connected to each other to constitute a single bracket, if desired.

A tension spring 19, which is a specific form of a biasing member, is anchored to each of the support pins 15 and 115 and movable rod 17 although the tension spring 19 assigned to the bracket 114 is not visible. As shown in FIGS. 1 and 2, such tension springs 19 constantly pull the movable rod 17 upward to the uppermost position where the rod 17 contacts the upper ends of the slots 16 and 116. In this condition, the rod 17 is positioned below the pins 15 and 115, but above the lower ends of the posts 6 and 106, and contact the surface portions of the posts 6 and 106 opposite to the surface portions facing the other post unit 3A, FIG. 1. The rod 17 therefore prevents the post unit 3 from being moved in the direction P, i.e., maintains the posts 6 and 106 standing substantially vertically on the mount surface 13 of the table 2.

Further, stops 24 and 124, implemented by pins, are studded on the brackets 14 and 114 at a level lower than the pins 15 and 115, but higher than the lower ends of the posts 6 and 106. The stops 24 and 124 contact the surface portions of the posts 6 and 106 facing the other post unit 3A. The stops 24 and 124 therefore also prevent the posts 6 and 106 from being moved in the direction P.

Figure 4:
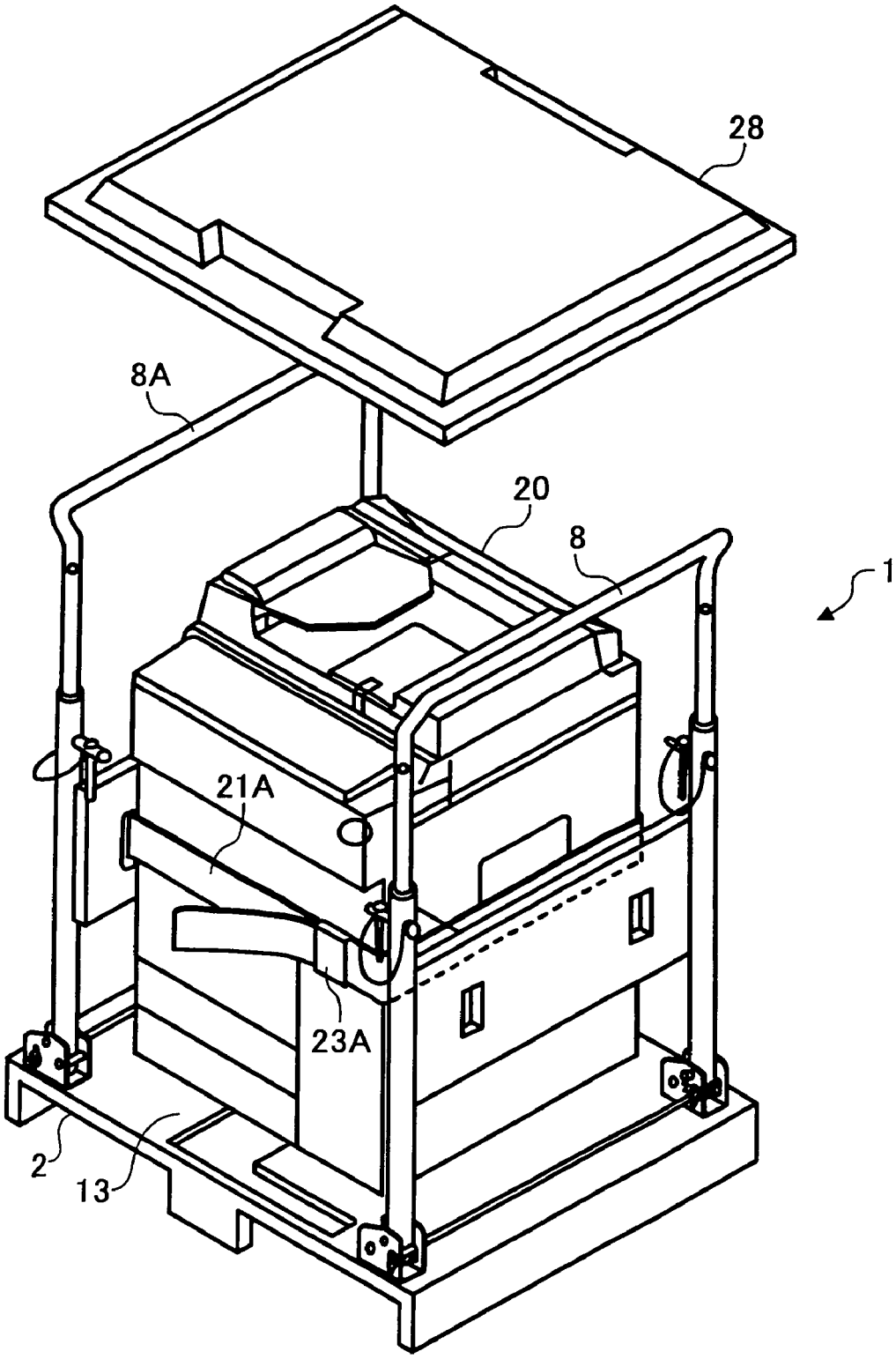
FIG. 4 is an isometric view showing a single article loaded on a table included in the illustrative embodiment.
Figure 5:
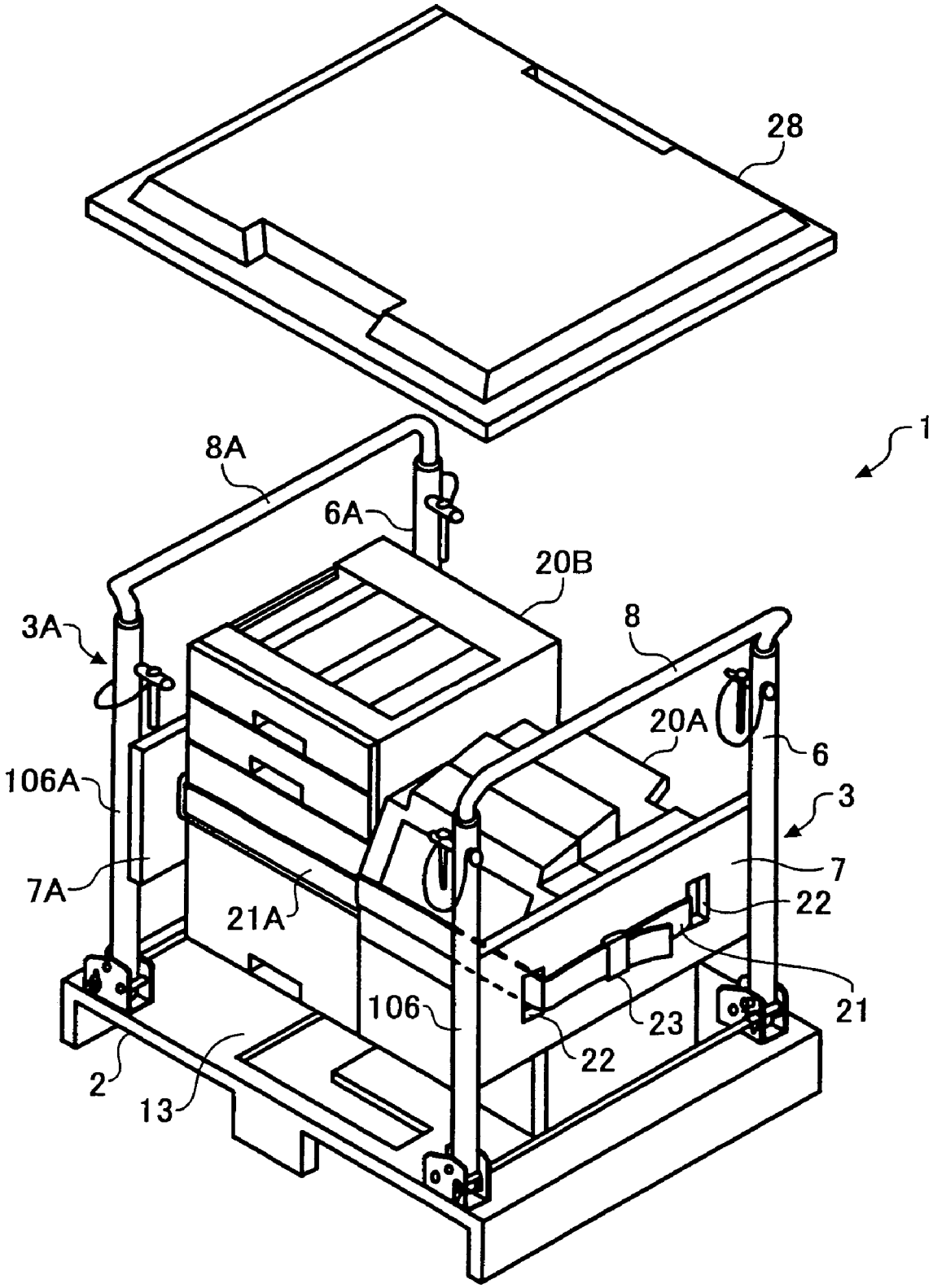
FIG. 5 is an isometric view showing two articles loaded on the table.

As shown in FIG. 4 or 5, an article 20 or articles 20A and 20B, respectively, are loaded on the mount surface 13 of the table 2 with the supports 6 and 106 and supports 6A and 106A standing upright on the table 2. The article 20 or the articles 20A and 20B can then be carried or stored together with the transporting/storing device 1.

Assume that a person unloads the article from the table 2 and then lowers the movable rod 17 against the action of the tension spring 19 by, e.g., stepping on the rod 17. Then, the rod 17 is moved below the lower ends of the posts 6 and 106 to thereby release the posts 6 and 106. Subsequently, the person may lower the frame 8 to the position shown in FIG. 3 and then push the post unit 3 toward the mount surface 13 in the direction P. This causes the posts 6 and 106 to angularly move about the pins 15 and 115, respectively, in the direction p with the result that the post unit 3 is folded up.

Figure 6:
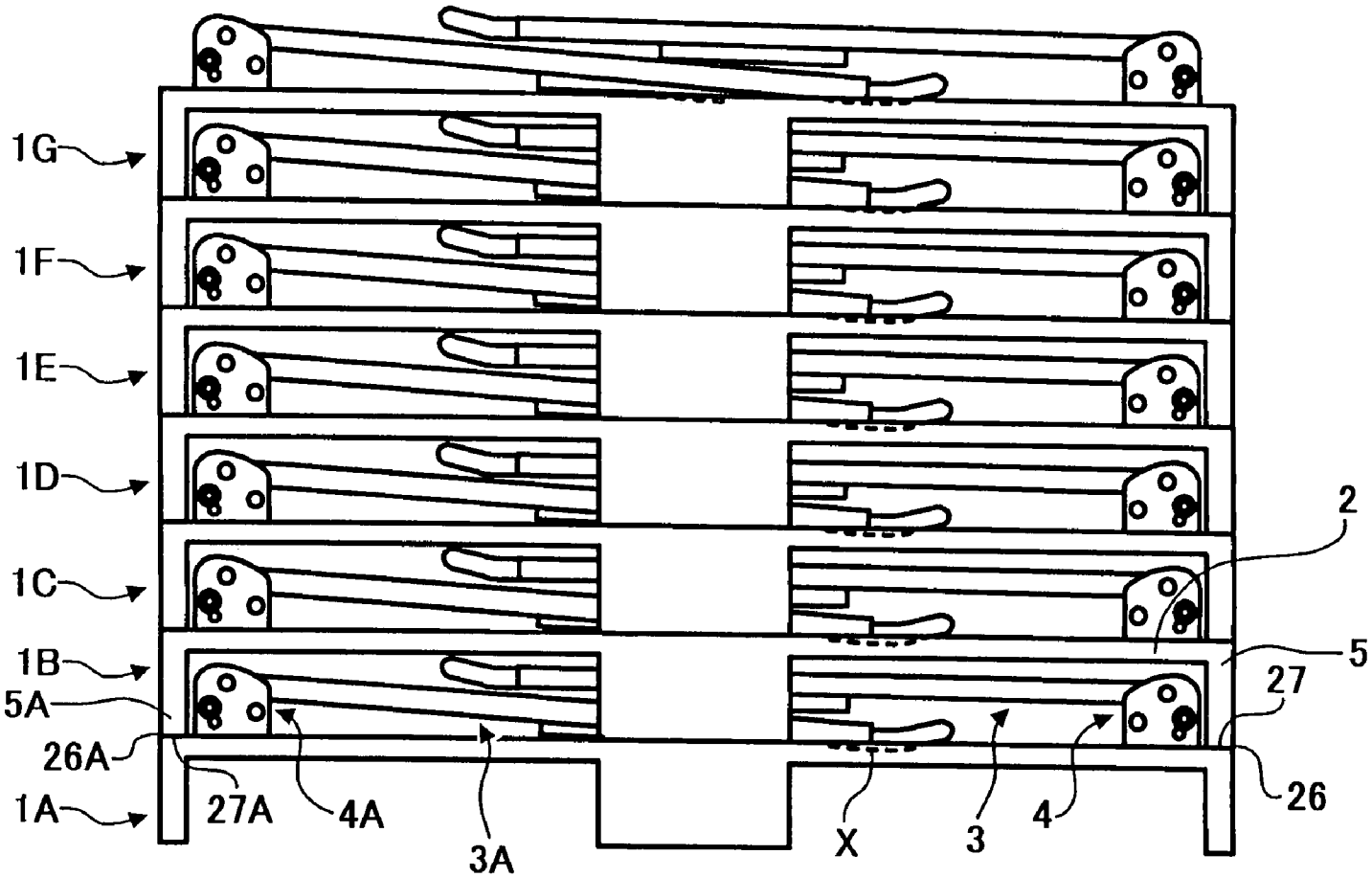
FIG. 6 is a front view showing a plurality of article transporting/storing devices stacked together with their post units being folded up.

The other post unit 3A, like the post unit 3, can be angularly moved in a direction indicated by an arrow PA. FIG. 3 shows a condition wherein the post unit 3A has begun to be folded downward in the direction PA. FIG. 6 shows the post units 3 and 3A in a fully folded position.

As stated above, the post units 3 and 3A can be folded up when the transporting/storing device 1 is stored or when it is returned to the original place after the article has been unloaded from the table 2 at a destination. Therefore, not only the transporting/storing device 1 is compact, but also the posts 6 and 106 do not have to be removed from the table 2. Further, as shown in FIG. 6, a plurality of transporting/storing devices 1 through 1F can be stacked one upon the other.

When the posts 3 and 3A are unfolded to the position shown in FIG. 1, the rods 17 and 17A and stops 24, 124, 24A and 124A again lock the posts 3 and 3A in the upright position.

Referring again to FIG. 1, a groove 25 is formed in the table 2 such that when the posts 3 and 3A are folded up, part of the post 3A (or part of the post 3) is received in the groove 25, as indicated by letter X in FIG. 6. The groove 25 may be configured to receive both of part of the post unit 3 and part of the post unit 3A, if desired. This configuration successfully reduces the height of the post units 3 and 3A when they are folded up. Therefore, as shown in FIG. 6, when a plurality of transporting/storing devices 1 and 1A are stacked one upon the other, the posts 3 and 3A of the lower device 1 are prevented from interfering with the table 2 of the upper device 1A.

Further, as shown in FIG. 1, the unit supporting means 4 and 4A are respectively positioned closer to the center of the table 2 than the opposite edges 26 and 26A of the table 2 by a distance Y, so that surfaces 27 and 27A are available on the table 2 between the unit supporting means 4 and 4A and the edges 26 and 26A, respectively. In addition, the legs 5 and 5A extend along the edges 26 and 26A, respectively. When the transporting/storing device 1A, FIG. 6, is stacked on the transporting/storing device 1 whose post units 3 and 3A have been folded up onto the table 2 , the legs 5 and 5A, FIG. 6, of the upper device 1A rest on the above surfaces 27 and 27A, respectively, as shown in FIG. 6. Therefore, a plurality of transporting/storing devices can be surely, stably stacked one upon the other.

In the illustrative embodiment, at least one of the back plates 7 and 7A is provided with a belt for retaining the article loaded on the table 2 . FIG. 1 shows a belt 21A attached to the back plate 7A although it is not shown in FIG. 3. The belt 21A is passed through a pair of holes 22A formed in the back plate 7A and has its opposite ends connected by an adjuster 23A to form a loop. By adjusting the adjuster 23A, it is possible to adjust the loop length of the belt 21A. As shown in FIG. 5, a belt 21 may, of course, be passed through a pair of holes 22 formed in the back plate 7 and provided with an adjuster 23.

In FIG. 4, a single article 20, which is a copier, is loaded on the transporting/storing device 2 and fastened by the belt 21A provided with the adjuster 23A. In FIG. 5, the articles 20A and 20B, which are respectively a printer body and a sheet feed table, are loaded on the transporting/storing device 2 and respectively fastened by the belts 21 and 21A. Because the belts 21 and 21A should only be passed through the holes 22 and 22A of the back plates 7 and 7A, respectively, the former can be easily attached to or detached from the latter.

The post units 3 and 3A respectively have two posts 6 and 106 and 6A and 106A connected together and respectively have the movable frames 8 and 8A movable in the up-and-down direction, as stated earlier. The frames 8 and 8A can therefore be raised to raise the post units 3 and 3A, respectively, when the relatively tall article 20 is to be carried or stored, as shown in FIG. 4, or can be lowered to lower the post units 3 and 3A when the relatively short articles 20A and 20B are to be carried or stored, as shown in FIG. 5. By lowering the post units 3 and 3A, it is possible to transport or store a plurality of transporting/storing devices in a stack.

As shown in FIG. 1, a top plate 28 may be set on the tops of the post units 3 and 3A, i.e., the tops of the movable frames 8 and 8A in the illustrative embodiment when the posts 6 and 106 and 6A and 106A are held in substantially the vertical position. In this case, another transporting/storing device 1A can be stacked on the top plate 28 of the transporting/storing device 1. At this instant, the top portions of the post units 3 and 3A should preferably be bent away from each other such that the legs 5 and 5A of the upper transporting/storing device 1A are positioned right above the movable frames 8 and 8A of the lower transporting/storing device 1 via the top plate 28. In this configuration, the frames 8 and 8A bear the load of the upper transporting/storing device 1A, so that a plurality of transporting/storing devices can be stably stacked together.

Figure 7:
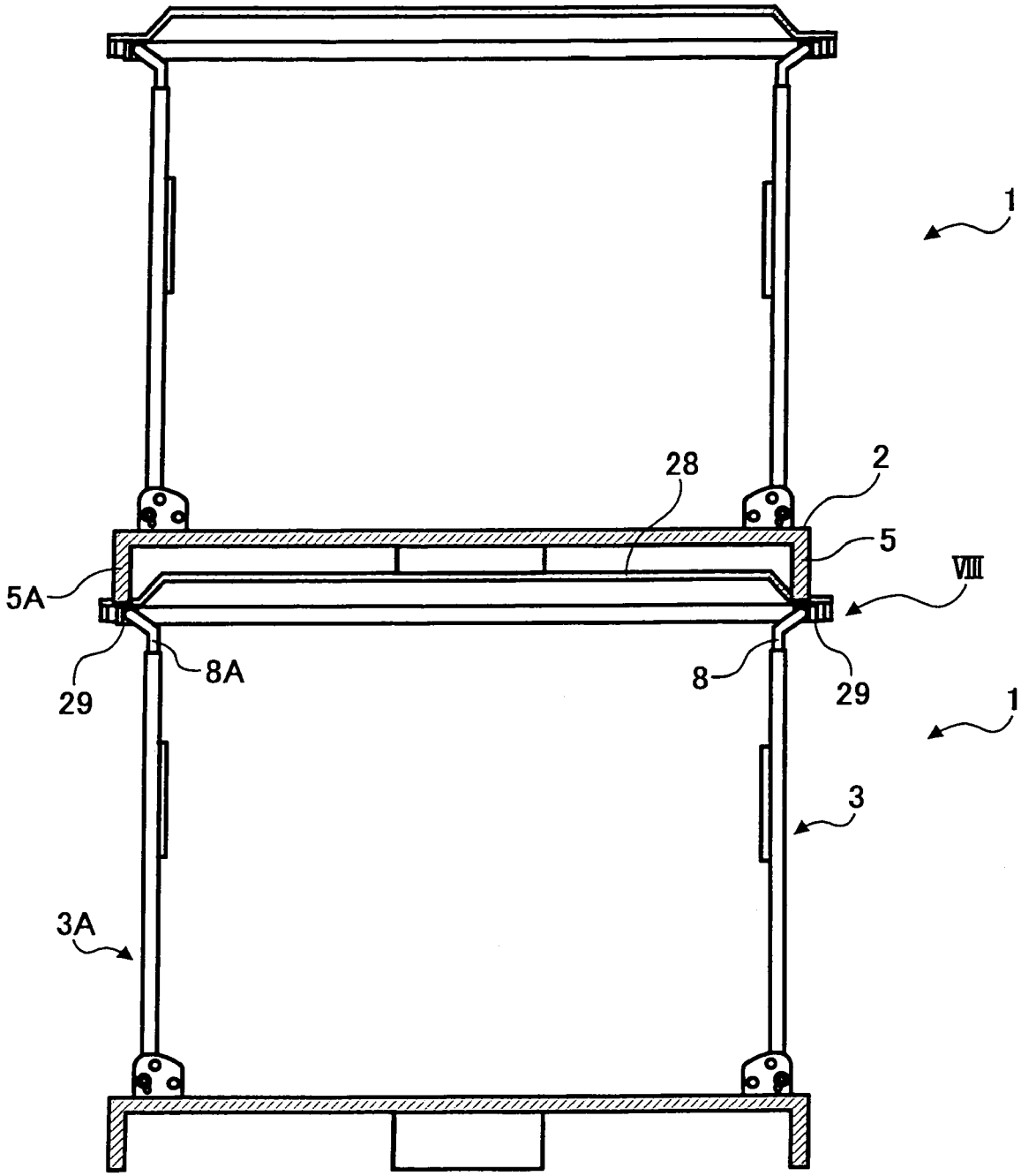
FIG. 7 is a partly sectional front view showing a plurality of article transporting/storing devices stacked together with their post units being held in an upright position.
Figure 8:
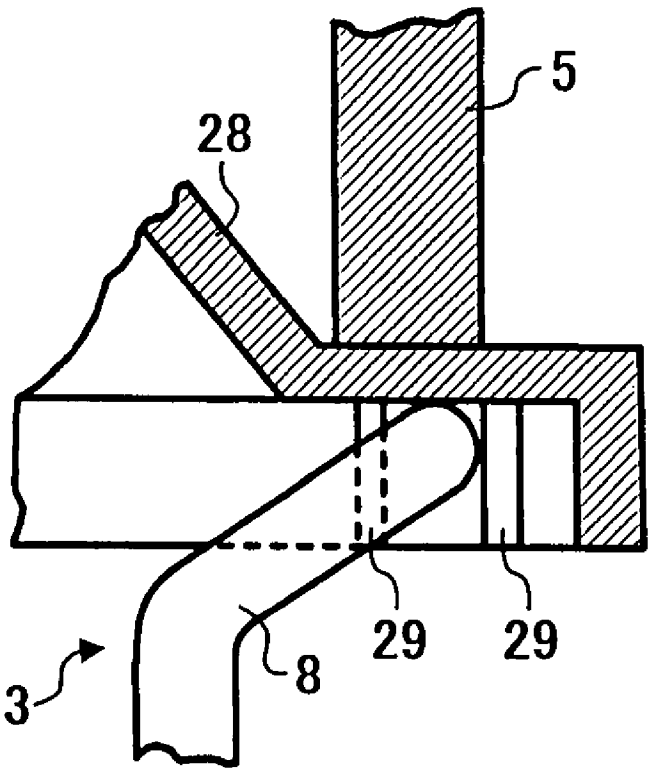
FIG. 8 is a fragmentary section showing a portion of FIG. 7 indicated by an arrow VIII.

As shown in FIG. 8, which shows a portion of FIG. 7 indicated by an arrow VIII in an enlarged scale, the top plate 28 includes an engaging portion 29 with which the top portion of the post unit 3 (or 3A), i.e., the top portion of the frame 8 (or 8A) is engaged. Such engaging portions 29 allow the top plate 28 to be stably mounted on the post units 3 and 3A without any play.

Figure 9:
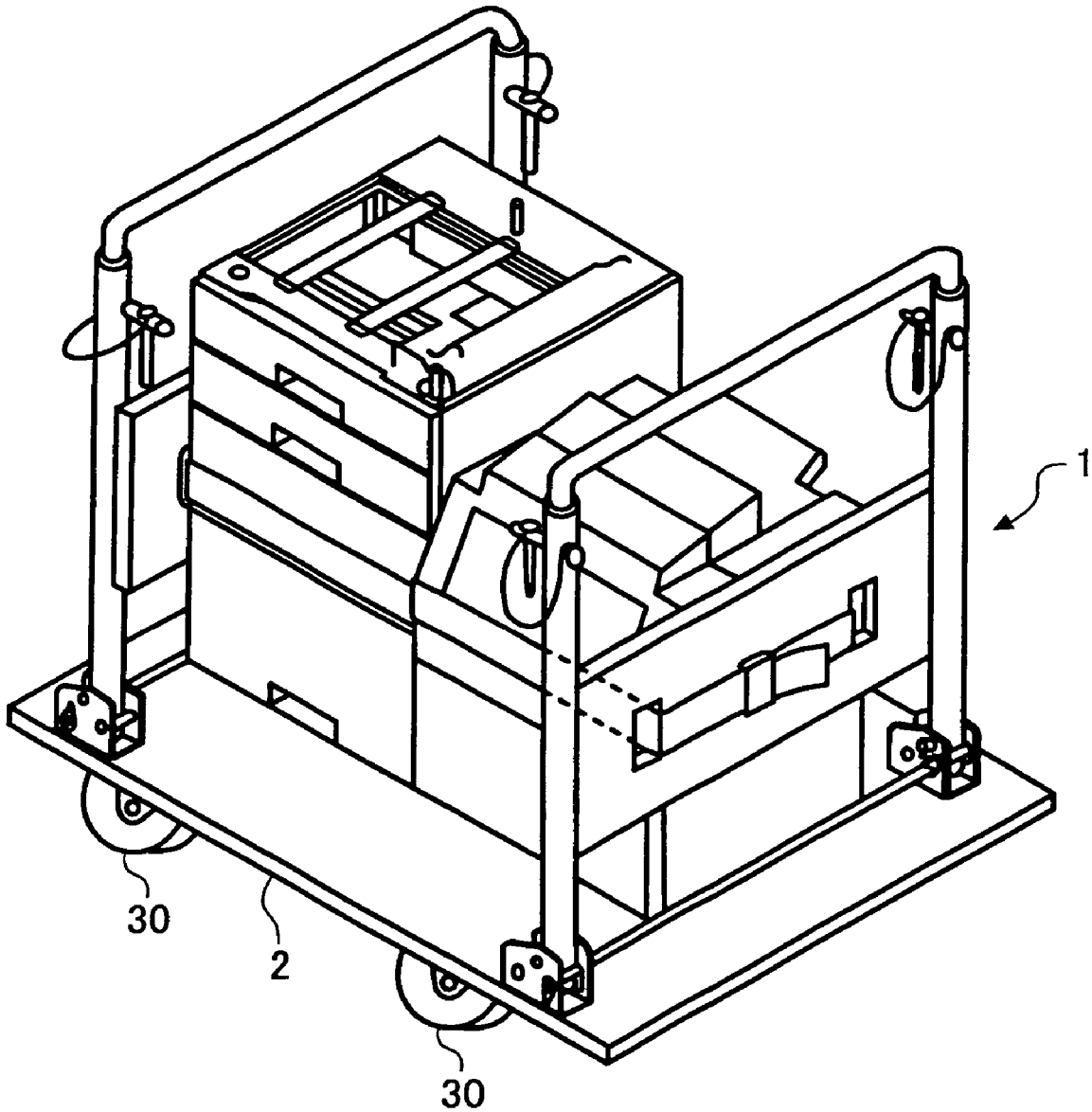
FIG. 9 is an isometric view showing a modification of the illustrative embodiment including casters.
Figure 10:
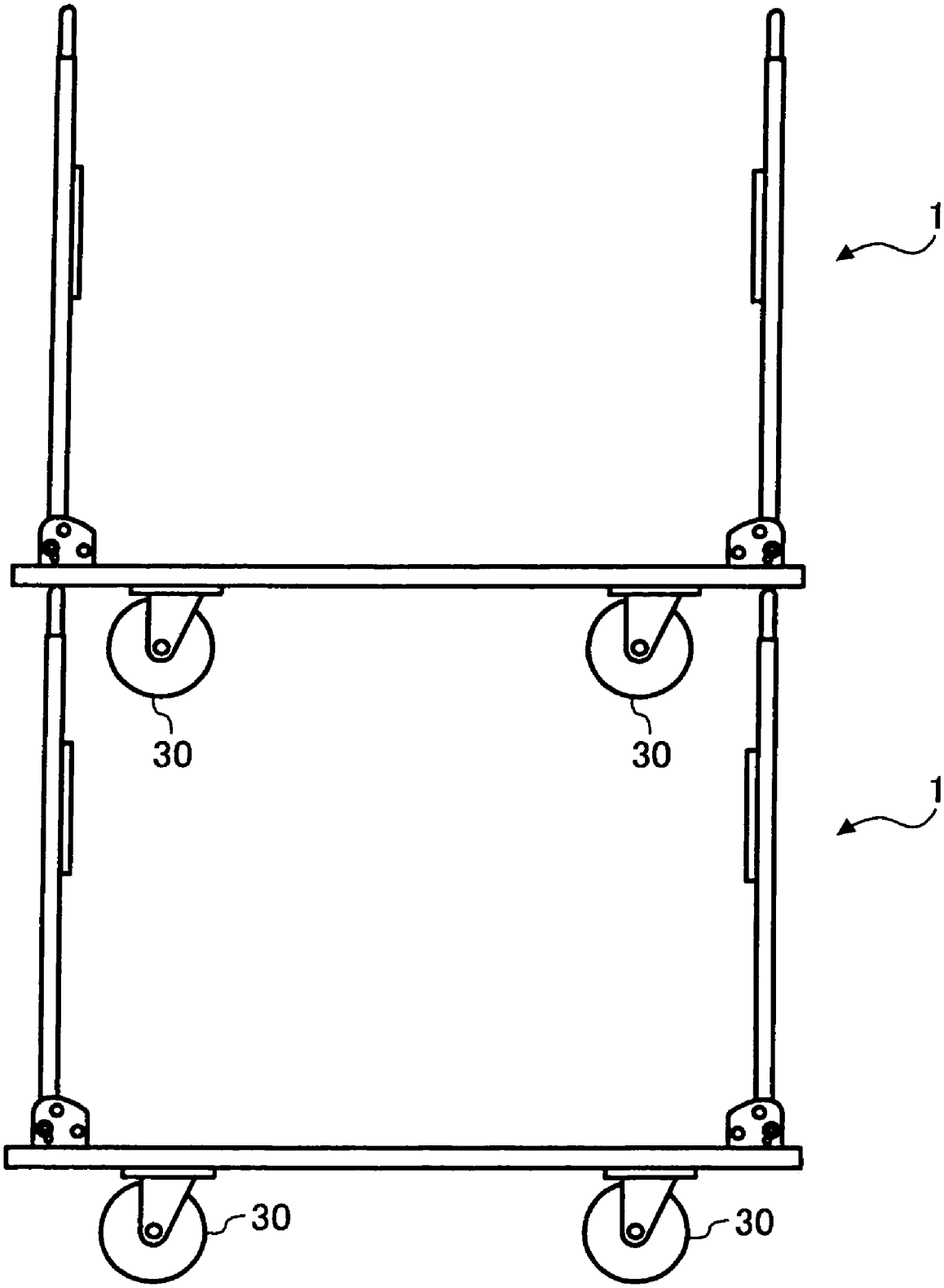
FIG. 10 is a front view showing a plurality of article transporting/storing devices each including the casters and stacked together.

Further, as shown in FIG. 9, casters 30 may be rollably mounted on the bottom of the table 2 so as to allow the transporting/storing device 1 to be easily moved. FIG. 10 shows the stack of the transporting/storing devices 1 and 1A each being provided with the casters 30.

In summary, it will be seen that the present invention provides an article transporting/storing device having post units that can be easily raised in the event of use or lowered in the event of transport or storage.

Various modifications will become possible for those skilled in the art after receiving the teachings of the present disclosure without departing from the scope thereof.

What is claimed is:

1. An article transporting/storing device comprising:

a table to be loaded with an article;

a pair of post units spaced from each other and each comprising two posts connected together; and a pair of unit supporting means supporting said pair of post units respectively on said table such that said pair of post units are selectively locked in a position in which said posts each stand substantially vertically on said table or unlocked and allowed to be angularly moved toward a mount surface of said table between said pair of post units, said pair of unit supporting means each comprise:

a pair of brackets affixed to said table and respectively supporting said two posts such that said two posts are angularly movable;

a movable rod mounted on said pair of bracket and configured as to be selectively movable upward or downward; and a biasing member constantly biasing said movable rod upward such that said movable rod contacts said two posts and is prevented from angularly moving toward said mount surface thereby;

wherein when said movable rod is pushed downward against an action of said biasing member, said movable rod is released from said two posts for thereby allowing said post unit to be angularly moved toward said mount surface.

2. The device as claimed in claim 1, wherein casters are mounted on said table.

3. The device as claimed in claim 1, further comprising a top plate to be set on upper end portions of said pair of post units when said posts stand substantially vertically on said table, wherein said top plate is formed with engaging portions engageable with said upper end portions of said pair of post units.

4. The device as claimed in claim 3, wherein casters are mounted on said table.

5. The device as claimed in claim 1, wherein said pair of post unit each include a respective movable frame connecting said two posts and mounted to said two posts in such a manner as to be movable in a lengthwise direction of said posts.

6. The device as claimed in claim 5, wherein said article transporting/storing device is a first article transporting/storing device and further comprises a top plate to be set on upper end portions of said pair of post units when said posts stand substantially vertically on said table, wherein upper end portions of said pair of post units are bent such that when a second article transporting/storing device is stacked on said top plate of said first article transporting/storing device, legs included in said second article transporting/storing device are positioned right above said upper end portions of said pair of post units via said top plate.

7. The device as claimed in claim 6, wherein said top plate is formed with engaging portions engageable with said upper end portions of said pair of post units.

8. The device as claimed in claim 7, wherein casters are mounted on said table.

9. The device as claimed in claim 1, wherein said article transporting/storing device is a first article transporting/storing device and wherein said unit supporting means is spaced from opposite edges of said table adjoining said pair of unit supporting means such that, when a second article transporting/storing device is stacked on said first article transporting/storing device after said pair of post units have been folded up by being angularly moved toward said mount surface, legs of a table of said second article transporting/storing device are positioned between unit supporting means and said edges of said table on said mount surface.

10. The device as claimed in claim 9, wherein said pair of post units each comprise a back plate connecting said two posts, and said back plate of at least one of said pair of post units is provided with a belt for fastening the article loaded on said table.

11. The device as claimed in claim 10, wherein said pair of post unit each include a respective movable frame connecting said two posts and mounted to said two posts in such a manner as to be movable in a lengthwise direction of said posts.

12. The device as claimed in claim 11, wherein said article transporting/storing device is a first article transporting/storing device and further comprises a top plate to be set on upper end portions of said pair of post units when said posts stand substantially vertically on said table, wherein upper end portions of said pair of post units are bent such that when a second article transporting/storing device is stacked on said top plate of said first article transporting/storing device, legs included in said second article transporting/storing device are positioned right above said upper end portions of said pair of post units via said top plate.

13. The device as claimed in claim 12, wherein said top plate is formed with engaging portions engageable with said upper end portions of said pair of post units.

14. The device as claimed in claim 13, wherein casters are mounted on said table.

15. The device as claimed in claim 1, wherein said table is formed with a groove for receiving, when said pair of post units are folded up by being angularly moved toward said mount surface, part of at least one of said pair of post units.

16. The device as claimed in claim 15, wherein said unit supporting means is spaced from opposite edges of said table adjoining said pair of unit supporting means such that, when another article transporting/storing device is stacked on said device after said pair of post units have been folded up by being angularly moved toward said mount surface, legs of a table of said another article transporting/storing device are positioned between said unit supporting means and said edges of said table on said mount surface.

17. The device as claimed in claim 16, wherein said pair of post units each comprise a back plate connecting said two posts, and said back plate of at least one of said pair of post units is provided with a belt for fastening the article loaded on said table.

18. The device as claimed in claim 17, wherein said pair of post unit each include a respective movable frame connecting said two posts and mounted to said two posts in such a manner as to be movable in a lengthwise direction of said posts.

19. The device as claimed in claim 18, further comprising a top plate to be set on upper end portions of said pair of post units when said posts stand substantially vertically on said table, wherein upper end portions of said pair of post units are bent such that when another article transporting/storing device is stacked on said top plate, legs included in said another article transporting/storing device are positioned right above said upper end portions of said pair of post units via said top plate.

20. The device as claimed in claim 19, wherein said top plate is formed with engaging portions engageable with said upper end portions of said pair of post units.

21. The device as claimed in claim 20, wherein casters are mounted on said table.

22. The device as claimed in claim 1, wherein said table is formed with a groove for receiving, when said pair of post units are folded up by being angularly moved toward said mount surface, part of at least one of said pair of post units.

23. The device as claimed in claim 22, wherein said unit supporting means is spaced from opposite edges of said table adjoining said pair of unit supporting means such that, when another article transporting/storing device is stacked on said device after said pair of post units have been folded up by being angularly moved toward said mount surface, legs of a table of said another article transporting/storing device are positioned between unit supporting means and said edges of said table on said mount surface.

24. The device as claimed in claim 23, wherein said pair of post units each comprise a back plate connecting said two posts, and said back plate of at least one of said pair of post units is provided with a belt for fastening the article loaded on said table.

25. The device as claimed in claim 24, wherein said pair of post unit each include a respective movable frame connecting said two posts and mounted to said two posts in such a manner as to be movable in a lengthwise direction of said posts.

26. The device as claimed in claim 25, further comprising a top plate to be set on upper end portions of said pair of post units when said posts stand substantially vertically on said table, wherein upper end portions of said pair of post units are bent such that when another article transporting/storing device is stacked on said top plate, legs included in said another article transporting/storing device are positioned right above said upper end portions of said pair of post units via said top plate.

27. The device as claimed in claim 26, further comprising, wherein said top plate is formed with engaging portions engageable with said upper end portions of said pair of post units.

28. The device as claimed in claim 27, wherein casters are mounted on said table.

* * * * *